United States Patent [19]

Rosenthal et al.

[11] 4,379,744

[45] Apr. 12, 1983

[54] COAL LIQUEFACTION PROCESS

[75] Inventors: Joel W. Rosenthal, El Cerrito; Arthur J. Dahlberg, Rodeo, both of Calif.

[73] Assignee: Chevron Research Company, San Francisco, Calif.

[21] Appl. No.: 299,917

[22] Filed: Sep. 8, 1981

Related U.S. Application Data

[63] Continuation-in-part of Ser. No. 194,730, Oct. 6, 1980, Pat. No. 4,330,393, which is a continuation-in-part of Ser. No. 12,185, Feb. 14, 1979, Pat. No. 4,330,390, which is a continuation-in-part of Ser. No. 754,198, Dec. 27, 1976, Pat. No. 4,330,389.

[51] Int. Cl.[3] ..... C10G 1/06; C10G 1/08; C10G 1/00

[52] U.S. Cl. ..... 208/10; 208/8 LE

[58] Field of Search ..... 208/8 LE, 10

[56] References Cited

U.S. PATENT DOCUMENTS

| | | | |
|---|---|---|---|
| 2,464,271 | 3/1949 | Storch et al. | 208/10 |
| 3,657,111 | 4/1972 | Gleim | 208/108 |
| 3,679,573 | 7/1972 | Johnson | 208/10 |
| 3,700,584 | 10/1972 | Johanson et al. | 208/10 |
| 3,705,092 | 12/1972 | Gotsic | 208/8 LE |
| 3,840,456 | 10/1974 | Yarorsky et al. | 208/8 LE |
| 3,925,188 | 12/1975 | Lester | 208/8 |
| 3,966,584 | 6/1976 | Gray et al. | 208/8 |
| 4,018,663 | 5/1977 | Karr, Jr. | 208/10 |
| 4,052,291 | 10/1977 | Espenscheid et al. | 208/8 LE |
| 4,054,504 | 10/1977 | Chervenak et al. | 208/10 |
| 4,110,192 | 8/1978 | Hildebrand et al. | 208/8 LE |
| 4,111,786 | 9/1978 | Segemuia et al. | 208/8 |
| 4,111,788 | 9/1978 | Chervenak et al. | 208/10 |
| 4,134,822 | 1/1979 | Wood et al. | 208/10 |
| 4,136,013 | 1/1979 | Moll et al. | 208/10 |
| 4,214,977 | 7/1980 | Ronganothan et al. | 208/10 X |
| 4,244,839 | 1/1981 | Aldridge et al. | 252/431 |
| 4,299,685 | 11/1981 | Khule et al. | 208/48 AA |

*Primary Examiner*—Delbert E. Gantz
*Assistant Examiner*—William G. Wright
*Attorney, Agent, or Firm*—D. A. Newell; S. R. La Paglia; A. H. Uzzell

[57] ABSTRACT

This invention is a process for liquefying coal in at least two stages, comprising (a) heating a slurry comprising a solid particulate coal, and an externally supplied dispersed dissolution catalyst in the presence of hydrogen in a first reaction zone to substantially dissolve the coal and provide a first effluent slurry having a normally liquid portion comprising solvent and dissolved coal and containing undissolved solids and dispersed dissolution catalyst; and (b) contacting at least a portion of said normally liquid portion containing undissolved solids and dispersed dissolution catalyst with hydrogen in a second reaction zone in the presence of a second externally supplied hydrogenation catalyst under hydrogenation conditions, including a temperature lower than the temperature to which said slurry is heated in step (a), to produce a second effluent slurry having a normally liquid portion.

Preferably, the dispersed dissolution catalyst in the first hydrogenation zone is added as an emulsion of aqueous soluble compounds of transition elements, e.g. from Groups IV-B, V-B, VI-B or Group VIII of the Periodic Table.

42 Claims, 1 Drawing Figure

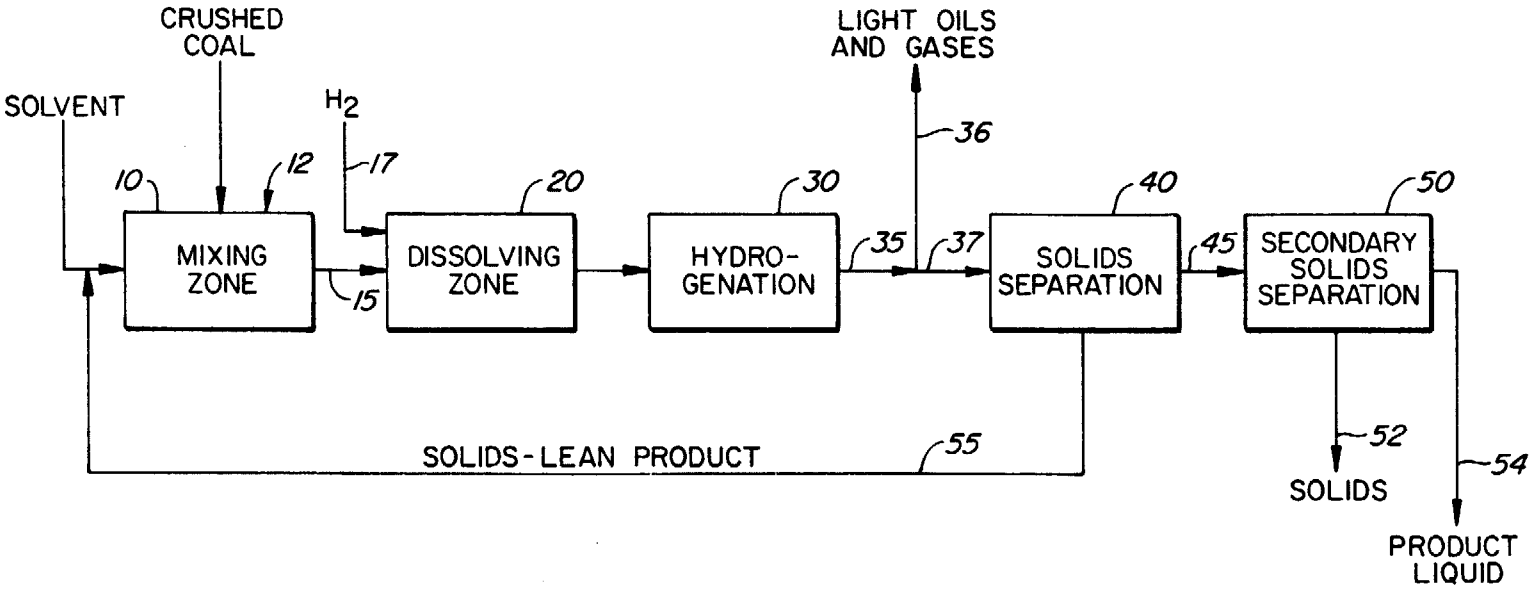
SOLVENT
CRUSHED COAL
10
12
MIXING ZONE
$H_2$
17
15
20
DISSOLVING ZONE
30
HYDRO-GENATION
35
37
LIGHT OILS AND GASES
36
40
SOLIDS SEPARATION
45
50
SECONDARY SOLIDS SEPARATION
52
SOLIDS
54
PRODUCT LIQUID
55
SOLIDS-LEAN PRODUCT

COAL LIQUEFACTION PROCESS

CROSS-REFERENCE TO RELATED APPLICATIONS

This application is a continuation-in-part of application Ser. No. 194,730, filed Oct. 6, 1980, now U.S. Pat. No. 4,330,393 which is a continuation-in-part of application Ser. No. 12,185, filed Feb. 14, 1979 now U.S. Pat. No. 4,330,390, which is a continuation-in-part of application Ser. No. 754,198, filed Dec. 27, 1976 now U.S. Pat. No. 4,330,389, the disclosures of which are incorporated herein by reference.

BACKGROUND OF THE INVENTION

The present invention relates to the liquefaction of coal to produce a normally liquid product which is low in sulfur and nitrogen and has a high API gravity. The invention also relates to the upgrading of coal/heavy petroleum oil slurries to provide low sulfur, low nitrogen products.

As a consequence of the increasing cost and diminishing supplies of petroleum, much research is being conducted into better ways of obtaining synthetic fuels from solids such as coal and from heavy petroleum oils. Furthermore, as a consequence of increased emphasis on the reduction of air pollution, fuels with low sulfur and low nitrogen contents are in great demand. Unfortunately, however, most coals and heavy oils contain large amounts of sulfur and nitrogen which necessitate additional costly sulfur and nitrogen removal steps, further increasing the cost of fuels derived from these sources.

In many processes for coal liquefaction hydrogen is supplied by a liquid donor solvent. In such processes the function of any catalyst is to rehydrogenate the solvent by adding molecular hydrogen to it; thus, the solvent acts as a medium to carry hydrogen from the catalyst to the solid coal. Numerous problems in prior art processes resulted from the presence of insoluble solids in the liquid product. Typically, the liquid product from a coal liquefaction process has a high molecular weight which makes it very difficult to separate fine insoluble solids, e.g., coal residue. It has generally been taught that these insoluble solids must be separated prior to further processing in order to prevent downstream catalyst deactivation.

Typical of the prior art processes is the Gulf catalytic coal liquefaction process disclosed in Coal Conversion Technology, Smith et al, Noyes Data Corporation, 1976, where a slurry of coal and process-derived solvent is forced up through a bed of catalyst at 900° F. and 2000 psig. The product, as taught in Sun W. Chung, National Science Foundation, Ohio State University Workshop, "Materials Problems and Research", Apr. 16, 1974, has a gravity of 1.2° API, a sulfur content of 0.11 weight percent and a nitrogen content of 0.63 weight percent.

Another typical and well known prior art process is the Synthoil process wherein a coal solvent slurry is pumped into a catalytic fixed bed reactor with hydrogen at a high velocity. Similarly to the above Gulf process, the Synthoil process also produces a liquid product, as taught in "Coal Liquefaction", Sam Friedman et al, presented at NPRA National Fuel and Lubricants meeting, November 6-8, 1974, Houston, Texas, which products have a gravity of −0.72° API and a sulfur content of 0.2 weight percent.

SUMMARY OF THE INVENTION

This invention comprises a process for liquefying coal which comprises:

(a) heating a slurry comprising a solid particulate coal, and an externally supplied dispersed dissolution catalyst in the presence of hydrogen in a first reaction zone to substantially dissolve the coal and provide a first effluent slurry having a normally liquid portion comprising solvent and dissolved coal and containing undissolved solids and dispersed dissolution catalyst; and (b) contacting at least a portion of said normally liquid portion containing undissolved solids and dispersed dissolution catalyst with hydrogen in a second reaction zone in the presence of a second externally supplied hydrogenation catalyst under hydrogenation conditions, including a temperature lower than the temperature to which said slurry is heated in step (a), to produce a second effluent slurry having a normally liquid portion.

Preferably, the dispersed dissolution catalyst in the first hydrogenation zone is added as an emulsion of aqueous soluble compounds of elements from Groups IV-B, V-B, VI-B or Group VIII of the Periodic Table. The solvent for the first hydrogenation zone can be provided, for example, as crude petroleum or a petroleum-derived solvent or the solvent can be obtained by recycling a portion of the normally liquid effluent from the second reaction zone, or from elsewhere in the process.

BRIEF DESCRIPTION OF THE DRAWING

The drawing is a schematic flow diagram of one preferred embodiment of the invention.

DETAILED DESCRIPTION OF THE INVENTION AND PREFERRED EMBODIMENTS

The process of the present invention is carried out in at least two separate and distinct stages. The coal is substantially dissolved in a high temperature first stage in the presence of hydrogen and an externally-supplied dissolution catalyst to substantially dissolve the coal, e.g., at least about 50% dissolution of the coal on a moisture and ash free basis. The term "externally-supplied" excludes materials which are naturally present in the feed, such as coal minerals, etc., and excludes coal minerals which might be present in liquid streams recycled to the dissolver. The effluent slurry from the dissolution step is composed of a normally liquid portion, (i.e., liquid at room temperature and atmospheric pressure) as well as light gases, ($H_2$, $C_4$—, $H_2O$, $NH_3$, $H_2S$, etc.) and undissolved solids. The undissolved solids comprise undissolved coal and ash particles. The dispersed dissolution catalyst, e.g., finely divided catalyst particles are also present in the normally liquid portion. The normally liquid portion comprises solvent and dissolved coal. The term "solvent" includes solvent materials which have been converted in the dissolution stage. The normally liquid portion containing undissolved solids, dispersed dissolution catalyst, and optionally the gaseous components is passed to a second reaction zone wherein it is reacted with hydrogen in the presence of a second externally supplied hydrogenation catalyst under hydrogenation conditions, including a temperature lower than the temperature to which the slurry is heated in the first step. If desired, the normally liquid effluent from the first stage can be treated in an intermediate step prior to passage to the second hydrogenation zone of this invention. The intermediate step can be treatment in a catalytic or non-catalytic reactor, a guard bed reactor, etc. Such intermediate steps are described in commonly assigned co-pending application Ser. No. 106,580, filed Dec. 26, 1979 now U.S. Pat. No. 4,300,996 entitled "Three-Stage Coal Liquefaction Process" and commonly assigned U.S. Pat. No. 4,264,430, issued Apr. 28, 1981, for "Three-Stage Coal Liquefaction Process" and in U.S. Pat. No. 4,283,268, issued Aug. 11, 1981, for "Two-Stage Coal Liquefaction Process With Interstage Guard Bed", the disclosure of which are incorporated herein by reference.

All that is required according to this invention is that at least a portion of the normally liquid product of the first reaction zone, with or without intermediate treatment and containing undissolved solids and dispersed catalyst, be contacted with hydrogen and a catalyst in the second zone operated at a lower temperature. Preferably the second hydrogenation zone contains a bed of hydrogenation catalyst particles, preferably in the form of catalytic hydrogenation components supported on an inorganic refractory porous support. The hydrogenation catalyst can be present as a fixed bed, a packed bed which can be a continuously or periodically moving bed, or an ebullating bed. Preferably the feed to the second catalytic zone is passed upwardly through the catalyst bed.

FEEDSTOCKS

The basic feedstock to the process of this invention is coal, e.g., bituminous coal, subbituminous coal, brown coal, lignite, peat, etc. The coal should preferably be ground finely to provide adequate surface for dissolution. Preferably the particle sizes of coal should be smaller than ¼ inch in diameter and most preferably smaller than 100 mesh (Tyler Sieve Size) and finer; however, larger sizes can be utilized. The coal can be added as a dry solid or as a slurry. If desired, the coal can be ground in the presence of a slurrying oil. The process of this invention is particularly suitable for the liquefaction of difficult-to-dissolve coals. Such coals contain a relatively small iron content, less than about 1%, or even less than 0.1%, on a moisture-free basis, and are typically low-rank coals such as subbituminous coal from the western United States. In addition, coals which have been preliminarily treated to lower the ash content and which contain less than about 1%, or even less than 0.1% iron on a moisture-free basis, are easily liquefied by the process.

SOLVENT

The solvent materials useful in the process of this invention are well known in the art and comprise aromatic hydrocarbons which are partially hydrogenated, generally having one or more rings at least partially saturated. Several examples of such materials are Tetralin (tetrahydronaphthalene), dihydronaphthalene, dihydroalkylnaphthalenes, dihydrophenanthrene, dihydroanthracene, dihydrochrysenes, and the like. The solvent or a portion thereof can conveniently be obtained from the process effluent of the second hydrogen zone by separating at least a portion of the insoluble solids from the normally liquid portion of the second stage effluent to provide a solids-lean carbonaceous liquid containing nondistillable liquid components and recycling at least a portion of the solids lean liquid to the first stage, for example by filtering and fractionating the effluent and recycling a portion of the 400° F. (200° C.) and higher boiling fraction. A portion of the undissolved solids and/or finely divided dissolution catalyst may also be recycled.

The solvent also may be crude petroleum, or a petroleum-derived solvent such as petroleum residua, tars, asphaltic petroleum fractions, topped crudes, tars from solvent deasphalting of petroleum, etc. Petroleum-derived solvents preferably contain only components boiling above about 400° F. (about 200° C.). When crude petroleum or petroleum-derived liquids which contain soluble metal contaminants, such as nickel, vanadium and iron, are employed as solvents in the process, soluble metals deposit on particles of unreacted coal or coal ash.

FIRST STAGE DISPERSED DISSOLUTION CATALYST

According to this invention, coal is dissolved in the solvent in the presence of hydrogen and a dispersed dissolution catalyst. The dissolution catalyst can be any of the well known materials available in the prior art, and contains an active catalytic component in elemental or compound form. Examples include finely divided particles, salts, or other compounds of tin, lead, or the transition elements, particularly Groups IV-B, V-B, VI-B or Group VIII of the Periodic Table of the Elements, as shown in *Handbook of Chemistry and Physics*, 45th Edition, Chemical Rubber Company, 1964. For purposes of this disclosure the dissolution catalyst composition is defined as the composition of the catalytic material added to the process, regardless of the form of the catalytic elements in solution or suspension.

The dispersed dissolution catalyst in the first stage can be dissolved or otherwise suspended in the liquid phase, e.g. as fine particles, emulsified droplets, etc. and is entrained from the first stage in the liquid effluent. The term "dispersed catalyst" is not intended to include catalyst particles present as a bed, either fixed, packed, moving, ebullated, expanded, or fluidized, or particles which might be entrained, e.g., unavoidably, from such beds during operation. The dispersed catalyst can be added to the coal before contact with the solvent, it can be added to the solvent before contact with the coal, or it can be added to the coal-solvent slurry. A particularly satisfactory method of adding the dispersed catalyst is in the form oil/aqueous solution emulsion of a water-soluble compound of the catalyst hydrogenation component. The use of such emulsion catalysts for coal liquefaction is described in U.S. Pat. No. 4,136,013 to Moll et al for "Emulsion Catalyst For Hydrogenation Processes" Jan. 23, 1979, the disclosure of which is incorporated herein by reference. The water soluble salt of the catalytic metal can be essentially any water soluble salt of metal catalysts such as those of the iron group, tin or zinc. The nitrate or acetate may be the most convenient form of some metals. For molybdenum, tungsten or vanadium, a complex salt such as an alkali metal or ammonium molybdate, tungstate, or vanadate may be preferable. Mixtures of two or more metal salts can also be used. Particularly preferred salts are ammonium heptamolybdate tetrahydrate [$(NH_4)_6Mo_7O_{24}.4H_2O$], nickel dinitrate hexahydrate [$Ni(NO_3)_2.6H_2O$], and sodium tungstate dihydrate [$NaWO_4.2H_2O$]. Any convenient method can be used to emulsify the salt solution in the hydrocarbon medium. A particular method of forming the aqueous-oil emulsion is described in the above-mentioned U.S. Pat. No. 4,136,013.

When the dissolution catalysts are to be added as finely divided solids they can be added as particulate metals, their oxides, sulfides, etc., e.g., $FeS_x$; waste fines from metal refining processes, e.g., iron, molybdenum, and nickel; crushed spent catalysts, e.g., spent fluid catalytic cracking fines, hydroprocessing fines, recovered coal ash, and solid coal liquefaction resides. It is contemplated that the finely divided dissolution catalyst added to the first stage will generally be an unsupported catalyst; that is, it need not be supported on inorganic carriers such as silica, alumina, magnesia, etc. However, as stated above, inexpensive waste catalyst fines containing catalytic metals may be used, if desired.

The dispersed dissolution catalyst can also be an oil-soluble compound containing a catalytic metal, for example, phosphomolybdic acid, naphthenates of molybdenum, chromium, and vanadium, etc. Suitable oil-soluble compounds can be converted to dissolution catalysts in situ. Such catalysts and their utilization are described in U.S. Pat. No. 4,077,867 for "Hydroconversion of Coal in a Hydrogen Donor Solvent with an Oil-Soluble Catalyst" issued Mar. 7, 1978, the disclosure of which is incorporated by reference.

Particulate coal can be mixed with a solvent, preferably in a solvent:coal weight ratio from about 1:2 to 4:1, more preferably, from about 1:1 to 2:1.

With reference to the drawing, the mixing can occur in the mixing zone 10 concurrently with the addition of finely divided catalyst to mixing zone 10 via line 12. The amount of dispersed catalyst added to mixing zone 10 is preferably from about 0.0001 to 0.01 pounds calculated as catalytic metal per pound of coal on a moisture and ash free basis. From mixing zone 10, the slurry is fed through line 15 to the dissolving zone 20. From the dissolving zone 20, the slurry is heated to a temperature preferably in the range of about 750° to 900° F., more preferably 800° to 850° F. and most preferably 820° to 840° F. for a length of time sufficient to substantially dissolve the coal. At least 50 weight percent and more preferably greater than 70% and still more preferably greater than 90% of the coal on a moisture and ash free basis is dissolved in zone 20, thereby forming a mixture of solvent, dissolved coal, catalyst, and insoluble coal solids. Hydrogen is also introduced in the dissolving zone through line 17, and can comprise fresh hydrogen and/or recycle gas. Carbon monoxide can be present in either reaction zone, if desired, but preferably the gas feed to both reactions is substantially free of added carbon monoxide. Reaction conditions in the dissolving zone can vary widely in order to obtain at least 50% dissolution of coal solids. Normally the slurry should be heated to at least about 750° F. in order to obtain at least 50% dissolution of the coal in a reasonable time. Further, the coal should not be heated to temperatures much above 900° F. since this results in thermal cracking which would substantially reduce the yield of normally liquid products. Other reaction conditions in the dissolving zone include a residence time of 0.01 to 3 hours, preferably, 0.1 to 1.0 hour, a pressure in the range of 100 to 10,000 psig, preferably 1500 to 5000 psig and more preferably 1500 to 2500 psig, a hydrogen gas rate of 1000 to 20,000 standard cubic feet per barrel of slurry and preferably 3000 to 10,000 standard cubic feet per barrel of slurry. It is preferred that the pressure in the dissolving zone be maintained above 500 psig. The feed may flow upwardly or downwardly in the dissolving zone, preferably upwardly. Preferably the zone is elongated sufficiently so that plug flow conditions are approached, which allow one to operate the process of the present invention on a continuous basis, rather than as a batch operation. A suitable flow distributor for introducing the feed into the dissolving zone is described in commonly assigned U.S. patent application Ser. No. 160,793 filed June 19, 1980 and entitled "Gas Pocket Distributor For An Upflow Reactor", which is incorporated herein by reference. The dissolving zone can be operated with no catalyst or contact particles from any external source, although the mineral matter contained in the coal may have some catalytic effect. It has been found, however, that the presence of the dispersed dissolution catalyst of this invention can result in the increased production of lighter liquid products, and in some cases, can increase the overall coal conversion in the process. It is preferred that the first stage dissolver contain no nominally non-catalytic contact particles such as alumina, silica, etc. Nominally non-catalytic particles are particles which do not contain transition metals as hydrogenation components.

SECOND HYDROGENATION ZONE

The dissolution zone effluent contains normally gaseous, normally liquid, and undissolved solid components including undissolved coal, coal ash, and particles of dispersed catalyst. This entire effluent from the first stage zone can be passed directly to the second stage hydrogenation zone 30. Optionally light gases, e.g., $C_4$—, water, $NH_3$, $H_2S$, etc. can be removed from the product of the first stage before passage to the second stage. Feed to the second stage preferably contains at least a major portion (more than 50% by weight) of the normally liquid product of the first stage, as well as the undissolved coal solids and dispersed hydrogenation catalyst. The liquid feed to the second stage should at least contain the heaviest liquid portion of the first stage liquid product, e.g., 400° F.+ or 650° F.+ fraction. In the second stage hydrogenation zone, the liquid-solid feed is contacted with hydrogen. The hydrogen may be present in the effluent from the first stage or may be added as supplemental hydrogen or recycle hydrogen. The second stage reaction zone contains the second hydrogenation catalyst, which is different from the dissolution catalyst employed in the first stage. The second stage hydrogenation catalyst is preferably one of the commercially available supported hydrogenation catalysts, e.g., a commercial hydrotreating or hydrocracking catalyst. Suitable catalysts for the second stage preferably comprise a hydrogenation component and a cracking component. Preferably the hydrogenation component is supported on a refractory cracking base, most preferably a weakly acidic cracking base such as alumina. Other suitable cracking bases include, for example, two or more refractory oxides, such as silica-alumina, silica-magnesia, silica-zirconia, alumina boria, silica-titania, clays and acid treated clays, such as attapulgite, sepiolite, halloysite, chrysotile, palygorskite, kaolinite, imogolite, etc. Suitable hydrogenation components are preferably selected from Group VI-B metals, Group VIII metals, or their oxides, sulfides and mixtures thereof. Particularly useful combinations are cobalt-molybdenum, nickel-molybdenum or nickel-tungsten, on alumina supports. A preferred catalyst is comprised of an alumina matrix containing about 8% nickel, 20% molybdenum, 6% titanium, and 2 to 8% phosphorus, such as can be prepared using the general cogelation procedures described in U.S. Pat. No. 3,401,125 to Jaffe, Sept. 10, 1968 for "Coprecipitation Method For Making Multicomponent Catalyst", which is incorporated herein by reference, wherein phosphoric acid is employed as a phosphorus source.

It is important in the process of the present invention that the temperatures in the second stage hydrogenation zone are not too high because it has been found that second stage catalysts rapidly foul at high temperatures. This is particularly important when fixed or packed beds are employed which do not permit frequent catalyst replacement. The temperature in the second hydrogenation zone should normally be maintained below about 800° F., preferably in the range above 600° F., and more preferably 650° to 750° F., however higher end-of-run temperatures may be tolerable in some cases. Generally the temperature in the second hydrogenation zone will always be at least about 25° F. below the temperature in the first hydrogenation zone, and preferably 100° to 150° F. lower. Other hydrogenation conditions in the second hydrogenation zone include a hydrogen pressure of 500 to 5000 psig, preferably, 1000 to 3000 psig, and more preferably 1500 to 2500 psig; hydrogen rates of 2000 to 20,000 standard cubic feet per barrel of slurry, preferably 3000 to 10,000 standard cubic feet per barrel of slurry; and a slurry hourly space velocity in the range of 0.1 to 2, preferably, 0.2 to 0.5. The pressure in the second catalytic hydrogenation zone can be essentially the same as the pressure in the first catalytic hydrogenation zone, if desired.

The second stage hydrogenation zone is preferably operated as an upflow packed or fixed bed; however, an ebullating bed may be used. The packed bed may move continuously or intermittently, preferably countercurrently to the slurry feed, in order to permit periodic incremental catalyst replacement. It may be desirable to remove light gases generated in the first stage and to replenish the feed in the second stage with hydrogen, since a higher hydrogen partial pressure will tend to increase catalyst life.

When a fixed or packed bed is employed in the second hydrogenation stage, it is preferred that the severity of the second stage be limited to avoid undesirable asphaltene precipitation which leads to undue plugging and pressure drops. This method of operation is described in commonly assigned U.S. patent application Ser. No. 278,796, filed June 29, 1981, for "Hydroprocessing Carbonaceous Feedstocks Containing Asphaltenes" incorporated herein by reference. The feed to the second stage is preferably fed through distributor system as disclosed in the above-mentioned commonly assigned U.S. patent application Ser. No. 160,793.

DOWNSTREAM PROCESSING

The product effluent 35 from hydrogenation zone 30 is separated into a gaseous fraction 36, and a solid liquid fraction 37. The gaseous fraction comprises light oils boiling below about 300° to 500° F., preferably below 400° F. and normally gaseous components such as $H_2$, CO, $CO_2$, $H_2S$ and the $C_1$–$C_4$ hydrocarbons. Preferably the $H_2$ is separated from other gaseous components and recycled to the second stage hydrocracking or the first stage dissolving stages as desired. The liquids and solids fraction 37 is fed to a solid separation zone 40, where the stream is separated into solids-lean stream 55 and solids-rich stream 45. Insoluble solids are separated by conventional means, for example, hydroclones, filtration, centrifugation, gravity settling or any combination of these. Preferably the insoluble solids are separated by gravity settling, which is a particularly added advantage of the present invention, since the effluent from the second hydrogenation reaction zone has a particularly low viscosity and high API gravity, generally at least −3, and up to as high as about 30° API. The high API gravity of the effluent allows rapid separation of the solids by gravity settling such that 50 weight percent and generally 90 weight percent of the solids can be rapidly separated in a gravity settler. Preferably the insoluble solids are removed by gravity settling at an elevated temperature in the range 200° to 800° F., preferably 300° to 400° F. and at a pressure in the range of 0 to 5000 psig, preferably 0 to 1000 psig. The solids-lean product stream which is removed via line 55 is recycled to the mixing zone while the solids-rich stream is passed to the secondary solids separation zone 50 via line 45. Zone 50 may include distillation, fluid coking, delayed coking, centrifugation, hydrocloning, filtration, settling, or any combination of the above. The separated solids are removed from zone 50 via line 52 and disposed of, while the product liquid is removed via line 54. The liquid product is essentially solids-free and can contain substantially less than 1.0 weight percent solids. The solids-lean product which is recycled to the mixing zone via line 55, preferably is treated to remove n-heptane insoluble asphaltenes as described in commonly assigned U.S. Pat. Nos. 4,225,248 and 4,264,429 incorporated herein by reference. When petroleum and petroleum-derived solids are employed, recycle of liquid effluent from the second stage is not necessary; however, recycle of a portion of the solids-lean carbonaceous liquid containing non-distillable liquid components to the dissolving stage can be employed, if desired, to promote hydrogenation of the heavy liquid components of the feed.

The process of the present invention can produce extremely clean normally liquid products. Normally liquid products, that is all the product fractions boiling above $C_4$, have an unusually high API gravity, at least −3, preferably above 0, more preferably above 5; a low sulfur content of generally less than 0.3 weight percent, preferably less than 0.2 weight percent; and a low nitrogen content generally less than 0.5 weight percent, preferably less than 0.2 weight percent.

As is readily apparent from the drawing, the process of the present invention is extremely simple and produces clean, normally liquid products from coal which are useful for many purposes. The broad range product is particularly useful as a turbine fuel while particular fractions are used for gasoline, diesel, jet and other fuels. The advantages of the present invention will readily be apparent from a consideration of the following examples.

EXAMPLE 1

(comparison)

In a slurrying vessel, finely divided Illinois #6 coal was slurried with a filtered recycle solvent (400° F.+), heated in the presence of added hydrogen, and passed upwardly through a dissolver free of catalyst or contact materials. The dissolver was operated at about 840° F., 2400 psig, a hydrogen gas rate of about 10,000 standard cubic feet/barrel, and a slurry hourly space velocity of 1.5. The entire product, comprising solvent, dissolved coal, and insoluble solids was passed directly to an upflow reactor containing a fixed bed of a sulfided hydrogenation catalyst comprising nickel, molybdenum, titanium and phosphorus supported on an alumina base. The fixed bed reactor was operated at about 690° F., 2400 psig, a hydrogen gas rate of about 10,000 standard cubic feet per barrel, and a slurry hourly space velocity of 0.33. The product from the fixed bed catalytic reactor was separated into a light gas fraction, a naphtha fraction, and a 400° F.+ fraction, which was filtered to provide a solids-lean 400° F.+ product. A portion of the solids-lean 400° F.+ product was recycled to the dissolver for use as solvent.

EXAMPLE 2

The process of Example 1 was carried out with essentially the same reaction conditions in both the dissolving stage and the catalytic reactor, and employing the same catalyst after about 850 additional hours on-stream. To the slurrying vessel was added an oil/aqueous emulsion of ammonium molybdate. The emulsion was prepared by dissolving one part by weight ammonium molybdate in fifteen parts water and slowly adding the solution with stirring to about fifty parts recycle oil solvent. The resulting mixture was agitated vigorously for several minutes until a visually stable emulsion was produced. Sufficient ammonium molybdate emulsion was added to the coal-solvent slurry to provide 100 ppmw ammonium molybdate relative to feed coal. The product inspection from Examples 1 and 2 are set forth in the Table.

TABLE

| | Example 1 | Example 2 | |
|---|---|---|---|
| Products, Wt % MAF | | | |
| $C_1$–$C_3$ | 9.2 | 10.8 | |
| $C_4$+ Liquids | 70.9 | 69.9 | |
| Undissolved Coal | 9.4 | 8.8 | |
| $NH_3$, $H_2S$, $H_2O$, $CO_x$ | 17.6 | 18.4 | |
| $C_4$+ Liquid Product, Inspections Wt % | | | |
| $C_4$—400° F. | 55.7 | 29.9 | 77.0 |
| 400–650° F. | | 47.1 | |
| 650–1000° F. | 38.6 | 18.7 | |
| 1000° F.+ | 5.7 | 4.4 | |
| Gravity, °API | 26.0 | 30.2 | |
| N, ppm | 680 | 560 | |
| S, ppm | 120 | 110 | |
| Atomic H/C Ratio | 1.63 | 1.71 | |
| $C_7$ Insoluble Asphaltenes, Wt % | 0.85 | 0.65 | |
| Oil Yield, B/MAFT | 4.5 | 4.6 | |
| $H_2$ Consumption, SCF/B | 5750 | 6300 | |

As shown in the Table, the presence of the dissolution catalyst results in an increased yield of $C_4$–650° F. liquids and a decreased yield of heavy 650°–1000° F. oil, with only a slight increase gas make ($C_1$–$C_3$).

EXAMPLE 3

(comparison)

In a slurry vessel, finely divided subbituminous coal containing 0.24 weight percent iron was slurried with a filtered recycle solvent (400° F.+) at a 1:2 coal/solvent ratio, heated in the presence of added hydrogen, and passed upwardly through a dissolver free of catalyst and contact materials. The dissolver operated at about 825° F., 2400 psig, a hydrogen gas rate of about 10,000 standard cubic feet/barrel, and a slurry hourly space velocity of 1.0. The entire product comprising solvent, dissolved coal, and insoluble solids was passed directly to an upflow reactor containing a fixed bed of hydrogenation catalyst as in Example 1. The fixed bed of reactor was operated at about 670° F., 2400 psig, a hydrogen gas rate of about 10,000 standard cubic feet per barrel, and a slurry hourly space velocity of 0.4. The product was separated as in Example 1 to obtain recycle solvent. After about five passes of recycle solvent through the system, the API gravity of the recycle sovlent dropped from 15.4° to 13.7° API and continued dropping to 12.2° API until the eighth pass when the run was terminated after a total of about 175 hours on-stream. The run was terminated by a plug which formed from a build-up of residue below the catalyst support screen in the catalytic reactor and a few inches into the bottom of the catalyst bed. The plug was found to be enriched in carbonates, which are believed to have been formed by oxidation of calcium species in the feed coal. See EPRI report AF 417, pp I-3-I-4 Electric Power Research Institute, Palo Alto, California (1977).

EXAMPLE 4

In a process run similar to Example 3, a different subbituminous coal feed containing 0.21 weight percent iron was slurried with a filtered recycle solvent (400° F.) at a 1:2 coal/solvent ratio, heated in the presence of added hydrogen and passed upwardly through a dissolver operating at about 825° F., 2400 psig, a hydrogen gas rate of about 10,000 standard cubic feet/barrel, and a slurry hourly space velocity of 1.0. The entire product comprising solvent, dissolved coal, and insoluble solids was passed directly to an upflow reactor containing a fixed bed of catalyst of the same composition as in Example 3. The fixed bed reactor was operated at 680° F., 2400 psig and a hydrogen rate of about 10,000 standard cubic feet per barrel, and a slurry hourly space velocity of 0.4. After about 180 hours on-stream a plug developed in the transfer line between the dissolver and the fixed bed reactor, interrupting the run. The run was restarted with a lower feed coal concentration of 3:1 coal/solvent ratio. An emulsion of ammonium molybdate prepared as in Example 2, was added to provide 250 ppmw ammonium molybdate relative to the feed coal. Coal conversion increased from about 76% (which was comparable to Example 2) to about 81%. Operation continued for 450 hours without plug formation.

EXAMPLE 5

This example illustrates operation with a petroleum solvent. Topped crude petroleum from Kern County, California, is slurried with finely divided Illinois #6 coal in a 3:1 solvent/coal weight ratio in a slurrying vessel. To the slurrying vessel is added a sufficient quantity of an aqueous/oil emulsion of ammonium molybdate to provide 250 ppmw ammonium molybdate relative to feed coal. The slurry is passed to a dissolver at 825° F. and a slurry hourly space velocity of 1.0, a pressure of 2400 psig and a hydrogen gas rate of 10,000 standard cubic feet per barrel. The entire effluent from the dissolver is fed to an upflow fixed bed catalytic reactor containing a sulfided Ni-Mo-Ti-P catalyst supported on alumina. The fixed bed reactor is operated at 0.4 slurry hourly space velocity, 700° F., 2400 psig and a hydrogen rate of 10,000 standard cubic feet per barrel.

The process of this invention is particularly desirable for coals which contain more than 0.5 weight percent calcium, on a moisture-free basis, particularly subbituminous or other low rank coals which contain 0.5–2 weight percent calcium.

It will be apparent to the workers in the art the process of this invention can be carried out with many different materials and in many configurations without departing from the spirit and scope of the process disclosed and claimed herein and such modifications are contemplated to be equivalents of this invention.

We claim:

1. A process for liquefying coal which comprises:
(a) heating a slurry comprising a solvent, particulate coal, and an externally supplied dispersed dissolution catalyst in the presence of hydrogen in a first reaction zone to substantially dissolve the coal and provide a first effluent slurry having a normally liquid portion comprising solvent and dissolved coal and containing undissolved solids and dissolution catalyst; and
(b) contacting at least a portion of said normally liquid portion containing undissolved solids and dissolution catalyst with hydrogen in a second reaction zone in the presence of a second externally supplied hydrogenation catalyst under hydrogenation conditions, including a temperature lower than the temperature to which said slurry is heated in step (a), to produce a second effluent slurry having a normally liquid portion.

2. A process according to claim 1 wherein said dispersed dissolution catalyst contains a catalytic element selected from the group consisting of lead, tin, and transition metal elements.

3. A process according to claim 1 wherein said dispersed dissolution catalyst is selected from the group of alkali metal or ammonium molybdates, vanadates, or tungstates.

4. A process according to claim 2 wherein said dispersed dissolution catalyst is added as an oil-soluble compound of said catalytic element.

5. A process according to claim 2 wherein said dispersed dissolution catalyst is added as a particulate metal or compound of said catalytic element.

6. A process according to claim 2 wherein said dispersed dissolution catalyst is added as an aqueous-oil emulsion of a water-soluble compound of said catalytic element.

7. A process according to claim 1 wherein said dispersed dissolution catalyst is added as an aqueous-oil emulsion of a compound selected from the group of ammonium molybdates and ammonium tungstates.

8. A process according to claim 1 wherein said dispersed dissolution catalyst is added as an aqueous-oil emulsion of ammonium molybdate.

9. A process according to claim 4, 5, or 6 wherein the second hydrogenation catalyst is present in a packed bed and said portion of said normally liquid portion of said first effluent slurry is passed upwardly through the packed bed in said second reaction zone.

10. A process according to claim 9 wherein said second reaction zone is operated at a temperature below about 800° F., a pressure from 1000 to 3000 psig, and a slurry hourly space velocity of 0.1 to 2.

11. A process according to claim 9 wherein said second hydrogenation catalyst comprises at least one hydrogenation component selected from Group VI-B and Group VIII, supported on an alumina support.

12. A process according to claim 9 wherein said coal contains less than about 1% by weight iron on a moisture-free basis.

13. A process according to claim 9 wherein said coal contains more than about 0.5% by weight calcium on a moisture-free basis.

14. A process according to claim 13 wherein said coal is subbituminous coal.

15. A process for liquefying coal which comprises:
(a) heating a slurry comprising a solvent, particulate coal and an externally supplied dispersed dissolution catalyst in the presence of hydrogen in a first reaction zone to substantially dissolve the coal and provide a first effluent slurry having a normally liquid portion comprising solvent and dissolved coal and containing undissolved solids and dissolution catalyst; and
(b) contacting at least a portion of said normally liquid portion containing undissolved solids and dissolution catalyst with hydrogen in a second reaction zone in the presence of a second externally supplied hydrogenation catalyst under hydrogenation conditions, including a temperature lower than the temperature to which said slurry is heated in step (a), to produce a second effluent slurry having a normally liquid portion; and
(c) separating at least a portion of the insoluble solids from said normally liquid portion of said second effluent slurry to produce a solids-lean carbonaceous liquid containing non-distillable liquid components, and recycling at least a portion of the solids-lean carbonaceous liquid containing non-distillable liquid components to step (a).

16. A process according to claim 15 wherein said dispersed dissolution catalyst contains a catalytic element selected from the group consisting of lead, tin, and transition metal elements.

17. A process according to claim 15 wherein said dispersed dissolution catalyst is selected from the group of alkali metal or ammonium molybdates, vanadates, or tungstates.

18. A process according to claim 16 wherein said dispersed dissolution catalyst is added as an oil-soluble compound of said catalytic element.

19. A process according to claim 16 wherein said dispersed dissolution catalyst is added as a particulate metal or compound of said catalytic element.

20. A process according to claim 16 wherein said dispersed dissolution catalyst is added as an aqueous-oil emulsion of a water-soluble compound of said catalytic element.

21. A process according to claim 20 wherein said dispersed dissolution catalyst is added as an aqueous-oil emulsion of a compound selected from the group of ammonium molybdates and ammonium tungstates.

22. A process according to claim 20 wherein said dispersed dissolution catalyst is added as an aqueous-oil emulsion of ammonium molybdate.

23. A process according to claim 18, 19, or 20 wherein the second hydrogenation catalyst is present in a packed bed and said portion of said normally liquid portion of said first effluent slurry is passed upwardly through the packed bed in said second reaction zone.

24. A process according to claim 23 wherein said second reaction zone is operated at a temperature below about 800° F., a pressure from 1000 to 3000 psig, and a slurry hourly space velocity of 0.1 to 2.

25. A process according to claim 23 wherein said second hydrogenation catalyst comprises at least one hydrogenation component selected from Group VI-B and Group VIII, supported on an alumina support.

26. A process according to claim 23 wherein said coal contains less than about 1% by weight iron on a moisture-free basis.

27. A process according to claim 23 wherein said coal contains more than about 0.5% by weight calcium on a moisture-free basis.

28. A process for liquefying coal which comprises:

(a) heating a slurry comprising a solvent, particulate coal, and an externally supplied dispersed dissolution catalyst in the presence of hydrogen in a first hydrogenation zone to substantially dissolve the coal and to provide a first effluent slurry having a normally liquid portion comprising solvent and dissolved coal and containing undissolved solids and dissolution catalyst, said solvent being selected from the group of petroleum and petroleum-derived solvents; and (b) contacting at least a portion of said normally liquid portion containing undissolved solids and dissolution catalyst with hydrogen in a second hydrogenation zone in the presence of a second externally supplied hydrogenation catalyst under hydrogenation conditions, including a temperature lower than the temperature to which said slurry is heated in step (a), to produce a second effluent slurry having a normally liquid portion.

29. A process according to claim 28 wherein said solvent is a petroleum-derived solvent containing metals contaminants.

30. A process according to claim 28 wherein said dispersed dissolution catalyst contains a catalytic component selected from the group consisting of lead, tin, and transition metal elements.

31. A process according to claim 30 wherein said dispersed dissolution catalyst is added as an oil-soluble compound of said catalytic element.

32. A process according to claim 30 wherein said dispersed dissolution catalyst is added as a particulate metal or compound of said catalytic element.

33. A process according to claim 30 wherein said dispersed dissolution catalyst is added as an aqueous-oil emulsion of a water-soluble compound of said catalytic element.

34. A process according to claim 28 wherein said dispersed dissolution catalyst is selected from the group of alkali metal or ammonium molybdates, vanadates, or tungstates.

35. A process according to claim 33 wherein said dispersed dissolution catalyst is added as an aqueous-oil emulsion of a compound selected from the group of ammonium molybdates, or ammonium tungstates.

36. A process according to claim 33 wherein said dispersed dissolution catalyst is added as an aqueous-oil emulsion of ammonium molybdate.

37. A process according to claim 31, 32, or 33 wherein the second hydrogenation catalyst is present in a packed bed and said portion of said normally liquid portion of said first effluent slurry is passed upwardly through the packed bed in said second reaction zone.

38. A process according to claim 37 wherein said second reaction zone is operated at a temperature below about 800° F., a pressure from 1000 to 3000 psig, and a slurry hourly space velocity of 0.1 to 2.

39. A process according to claim 37 wherein said second hydrogenation catalyst comprises at least one hydrogenation component selected from Group VI-B and Group VIII supported on an alumina support.

40. A process according to claim 37 further comprising separating at least a portion of the insoluble solids from said second effluent slurry to produce a solids-lean carbonaceous liquid containing non-distillable liquid components and recycling at least a portion of the solids-lean carbonaceous liquid containing non-distillable liquid components to step (a).

41. A process according to claim 37 wherein said coal contains less than about 1% by weight iron on a moisture-free basis.

42. A process according to claim 37 wherein said coal contains more than about 0.5% by weight calcium on a moisture-free basis.

* * * * *